US007735171B2

(12) United States Patent
Kan

(10) Patent No.: US 7,735,171 B2
(45) Date of Patent: Jun. 15, 2010

(54) SUPPORT STRUCTURE WITH SIDE GUARDS

(75) Inventor: Tsung Chung Kan, Tu-Cheng (TW)

(73) Assignee: Apex Medical Corp., Taipei County (TW)

( * ) Notice: Subject to any disclaimer, the term of this patent is extended or adjusted under 35 U.S.C. 154(b) by 0 days.

(21) Appl. No.: 12/289,628

(22) Filed: Oct. 31, 2008

(65) Prior Publication Data

US 2009/0119838 A1 May 14, 2009

(30) Foreign Application Priority Data

Nov. 9, 2007 (TW) ..... 96218879 U

(51) Int. Cl.
*A47C 17/00* (2006.01)

(52) U.S. Cl. ..... 5/732; 5/621; 5/710

(58) Field of Classification Search ..... 5/621, 5/732, 710, 424, 425, 426
See application file for complete search history.

(56) References Cited

U.S. PATENT DOCUMENTS 4,712,258 A * 12/1987 Eves ..... 5/424
5,421,044 A 6/1995 Steensen
5,455,973 A * 10/1995 Brumfield et al. ..... 5/424
6,085,372 A * 7/2000 James et al. ..... 5/713
6,481,030 B2 * 11/2002 Bravo et al. ..... 5/425
7,107,635 B2 9/2006 Henry et al.
2005/0138730 A1 * 6/2005 Henry et al. ..... 5/482
2007/0101504 A1 * 5/2007 Gilchrest et al. ..... 5/706
2008/0163424 A1 * 7/2008 Mobley ..... 5/426

* cited by examiner

*Primary Examiner*—Peter M. Cuomo
*Assistant Examiner*—William Kelleher
(74) *Attorney, Agent, or Firm*—Rosenberg, Klein & Lee

(57) ABSTRACT

A support structure includes a mattress, a bottom sheet, at least one side guard and at least one positioning assembly. The mattress has a plurality of bladders. The side guard is disposed on any one lateral side of the top surface of the mattress. The positioning assembly can fix the side guard to the mattress. The side guard can protect two sides of a bedded person and prevent the bedded person from falling from the mattress. When the side guard is pushed by an external force, the bedded person does not fall into the vertical gap.

20 Claims, 20 Drawing Sheets

SUPPORT STRUCTURE WITH SIDE GUARDS

BACKGROUND OF THE INVENTION

1. Field of the Invention

The present invention relates to a support structure, and particularly relates to a support structure having a mattress and at least one side guard stacked on the mattress.

2. Description of the Related Art

A support structure is applied to medical treatment for providing appropriate bedding for patients by filling air into the support structure or exhaust air from the support structure. Referring to FIGS. 1 and 2, the prior art provides a support structure that includes a support layer 91, a bottom sheet 92 and two bolsters 93. The support layer 91 is received in the bottom sheet 92. The support layer 91 is composed of a plurality of inflatable cells. The two bolsters 93 are respectively disposed on two lateral sides of the support layer 91, and the height of each bolster 93 is larger than the height of the support layer 91. Each inflatable cell of the support layer 91 and each bolster 93 are connected to a pump via a pipe, and air is filled into each inflatable cell and each bolster 93 by operating a control device to properly inflate or deflate.

Because the two bolsters 93 are respectively disposed on two lateral sides of the support layer 91, the shape of each bolster 93 can change easily and each bolster 93 loses its protection function. When the air pressure in the bolsters 93 is insufficient, the bedded person will fall into a gap between the support layer and each side guard easily. Hence, it is dangerous for a bedded person to use the support structure of the prior art. Moreover, the size of the inflatable cell needs to be changed according to different sizes of the side guard. Hence, the manufacturer needs to make many different inflatable cells with different sizes. The manufacturing efficiency is bad and needs to be improved.

Moreover, U.S. Pat. No. 5,421,044 discloses an air bed that includes an enclosure formed by a flat rectangular bottom panel, a lower vertical panel standing up perpendicularly from the periphery of the bottom panel, an upper vertical panel disposed above the lower vertical panel, a gusset connecting the lower and upper vertical panels, a rectangular top panel removably connected to the upper vertical panel, and a plurality of restraining straps, with one end of each restraining strap connected to the gusset along the left side of the enclosure and the other end of each restraining strap attached to the gusset along the right side of the enclosure. The enclosure has upper levels and lower levels separated by the restraining straps. Inflatable air tubes are inserted in each level. Each level of tubes includes bolster tubes inserted parallel and adjacent to the sides and ends of the enclosure, and cushion tubes which are disposed laterally across the enclosure in the rectangular space surrounded by the bolster tubes. Each tube has sheathing surrounding it to reduce noise when adjacent tubes rub against each other, and attachment means are used to prevent rotation of the tubes. An air pump provides air pressure to the inflatable tubes through a manifold block having several separate, variably controlled output ports. An air hose assembly connects the manifold's output ports to the various tubes so that certain combinations of tubes receive various amounts of air pressure. In addition, the invention includes a single level embodiment. However, the bolster tubes are fixed, not easy to move.

Furthermore, U.S. Pat. No. 7,107,635 discloses a fitted bed sheet that has a pair of roll guards mounted thereon to prevent a toddler or other person from rolling out of the bed. Each roll guard is removably disposed in a slip cover mounted on the sheet by a flexible strip of material, which allows each roll guard to move between a first position atop the sheet and a second position beside the sheet with the roll guard hanging from the flexible strip. Each roll guard is securable in the raised position by linking of fastener strips having hook and loop fasteners mounted on the slip cover and fabric loops mounted on the sheet. Each roll guard is removably mounted to the sheet via a zipper between the sheet and the flexible strip of material mounted on the slip cover. A plurality of elastic straps is mounted axially on the bottom of the sheet to help secure the sheet on a mattress. But the loop that is mounted on top panel of sheet is easy to be cut off by the horizontal force caused by the patient to move position.

SUMMARY OF THE INVENTION

One particular aspect of the present invention is to provide a support structure with side guards. The support structure includes a mattress, a bottom sheet, at least one side guard and at least one positioning assembly. The mattress has a plurality of bladders. The bottom sheet has an interior region for receiving the mattress. The side guard is disposed on any one lateral side of the top surface of the mattress. The positioning assembly can fix the side guard to the mattress. The side guard can protect two side of a bedded person and prevent the bedded person from falling from the mattress. Because the side guard is disposed on any one lateral side of the top surface of the mattress, the gap between the side guard and the mattress is horizontal (the gap of the prior art is vertical). Hence, when the side guard is pushed by external force, the bedded person does not fall into the vertical gap. Moreover, the side guard can help the bedded person lie on correct position.

Furthermore, at least one connection belt is attached to the bottom sheet and encloses the outer edge of the side guard. The side guard can be at least one foam body or at least one bladder, and the side guard can be drawn out easily. Hence, the side guard is replaceable according to different requirements for different bedded persons. The connection belt has a bladder disposed on its outer end. When the bladder is inflated by air, the bladder can form the side guard.

Moreover, the positioning assembly can fix the side guard to the mattress, so that the side guard is not easily pushed aside. The positioning assembly has at least one first positioning element that can be a non-skid pad in order to prevent the side guard from being pushed along horizontal direction and from falling easily from the mattress.

In addition, the positioning assembly has at least one second positioning element that connects the bottom sheet to the side guard. Hence, the second positioning element not only can fix the side guard to the mattress, but also can prevent the side guard from being lifted and from falling down. A fastener connects the second positioning element to the bottom sheet. The fastener can be adhesive portion or snap. The bottom sheet has an opening formed on its bottom side. The fastener is disposed on an outer side of the bottom sheet, and the fastener passes through the opening in order to connect the bottom side of the bottom sheet. Therefore, the fastener is pressed by the weight of the bedded person, so it can increase the fastening force and it is hard for a bedded person to push or lift the side guard.

Furthermore, the positioning assembly has a third positioning element that is disposed on the connection belt. It is convenient for user to assemble or detach the side guard. The third positioning element has a pair of zippers, at least one pair of snaps, or at least one pair of adhesive portions. Hence, it is convenient for user to assemble or detach the side guard by, using the third positioning element.

Of course, the first positioning element, the second positioning element and the third positioning element can be selectively mated with each other to form the positioning assembly according to different requirements.

Therefore, the side guard is stacked on two lateral sides of the top surface of the mattress and is restricted by using the positioning assembly to protect the bedded person, so that the size of the bladders does not need to be modified. Hence, the side guard matching with the positioning assembly can add product variety and decrease storing costs.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF PREFERRED EMBODIMENTS

Figure 1:
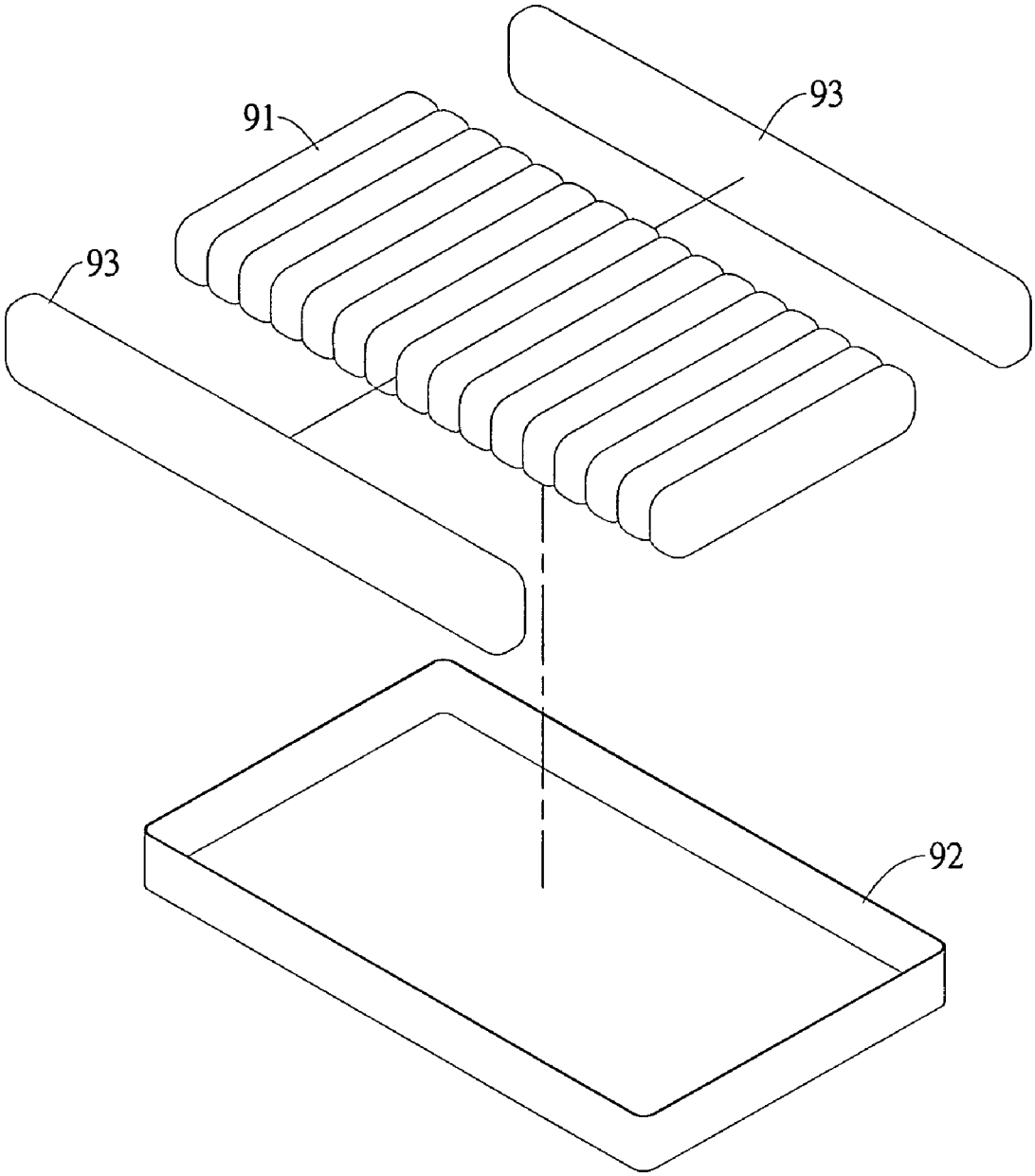
FIG. 1 is an exploded view of a support structure with bolsters according to the prior art.
Figure 2:
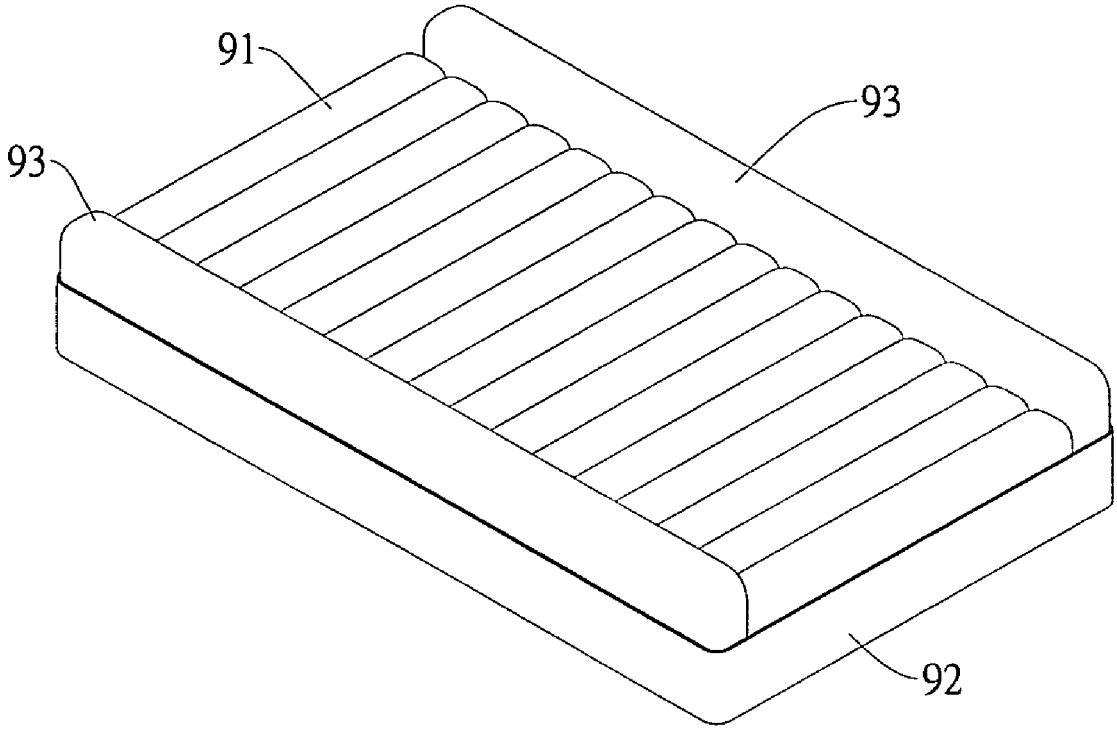
FIG. 2 is an assembled view of a support structure with bolsters according to the prior art.
Figure 3:
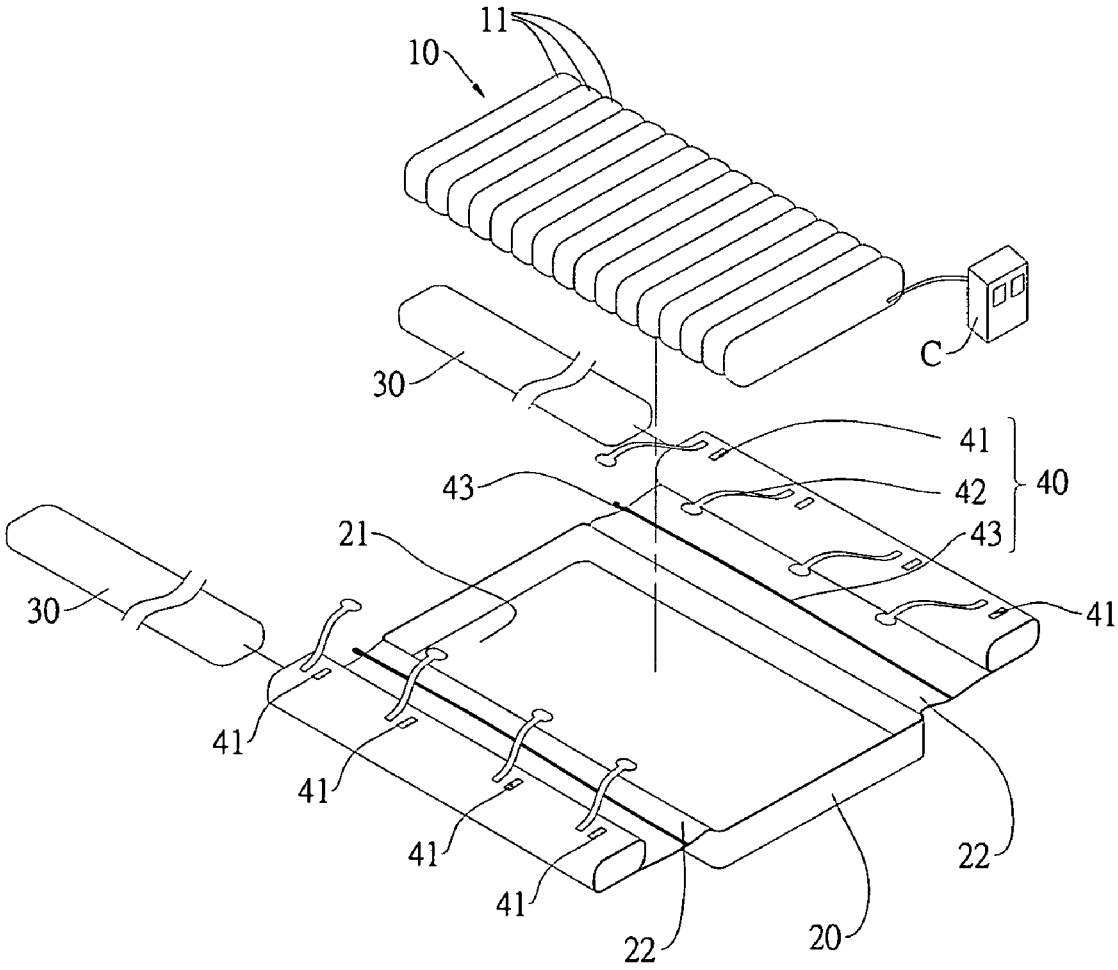
FIG. 3 is an exploded view of a support structure with side guards using first, second and third positioning elements according to one embodiment of the present invention.

Referring to FIG. 3, the present invention provides a support structure with side guards. The support structure includes a mattress 10, a bottom sheet 20, at least one side guard 30 and at least one positioning assembly 40. The present embodiment uses a pair of side guards 30, and the two side guards 30 are respectively disposed on two lateral sides of the top surface of the mattress 10 in order to protect two sides of a bedded person and prevent the bedded person from falling from the mattress 10. Of course, the position of the two side guards 30 on the mattress 10 can be adjusted to suit different situations and body sizes.

Figure 4:
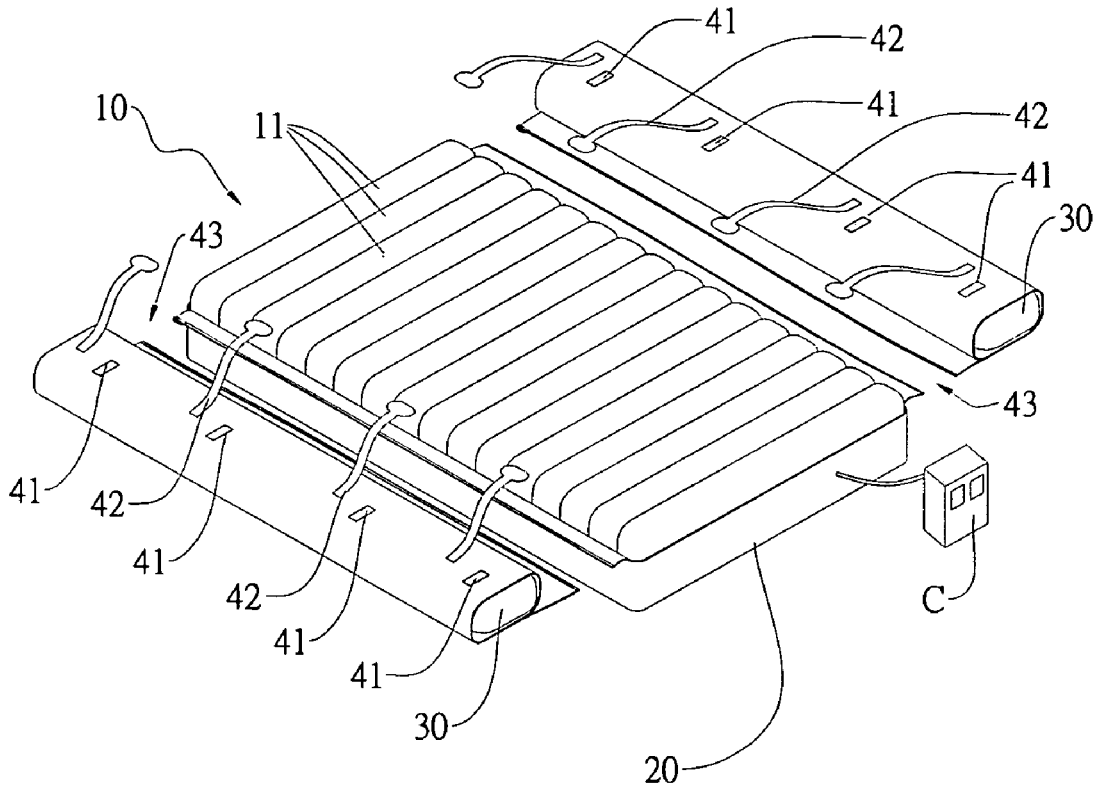
FIG. 4 is an assembled view of a support structure with side guards using first, second and third positioning elements according to one embodiment of the present invention.
Figure 5:
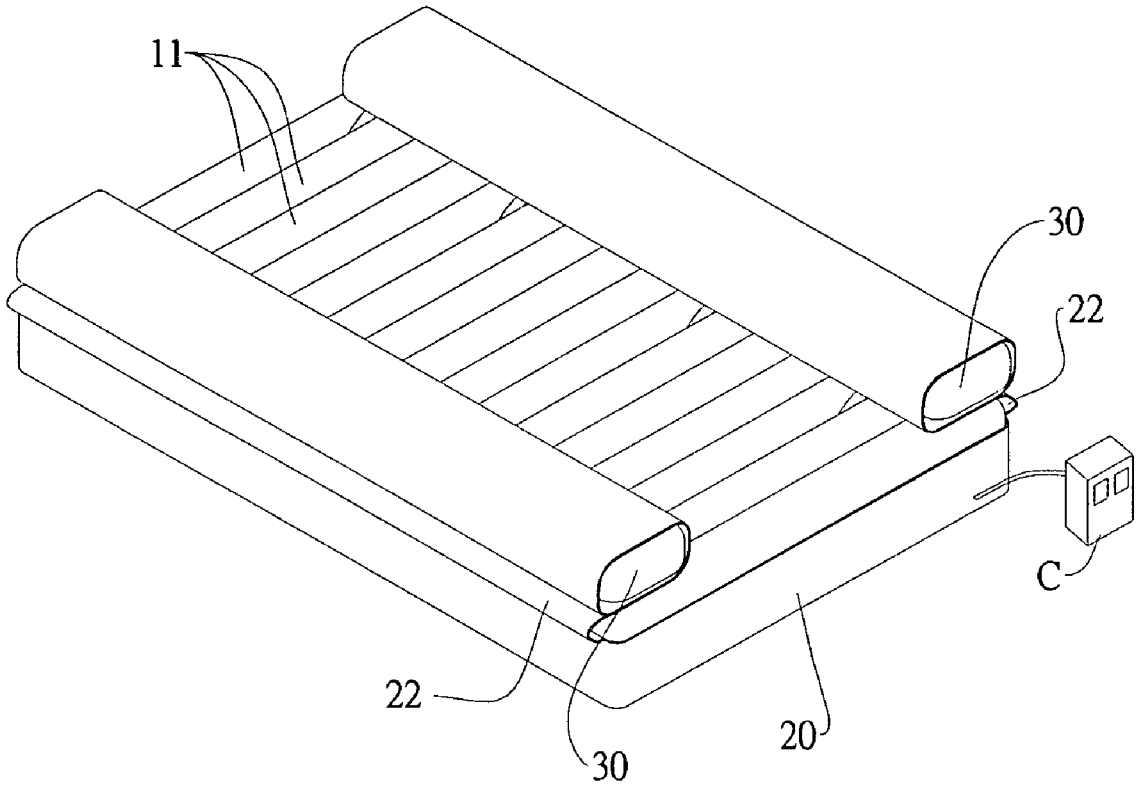
FIG. 5 is an assembled view of a support structure with side guards according to one embodiment of the present invention.

Referring to FIGS. 3 to 5, the mattress 10 has a plurality of bladders 11 to form a bedding area for the human body. The bottom sheet 20 has an interior region 21 formed by high-frequency welding or machine sewing. The mattress 10 is received in the interior region 21. In addition, the positioning assembly 40 can fix the side guard 30 to the mattress 10, so that the side guard 30 does not fall easily from the mattress 10.

Figure 6:
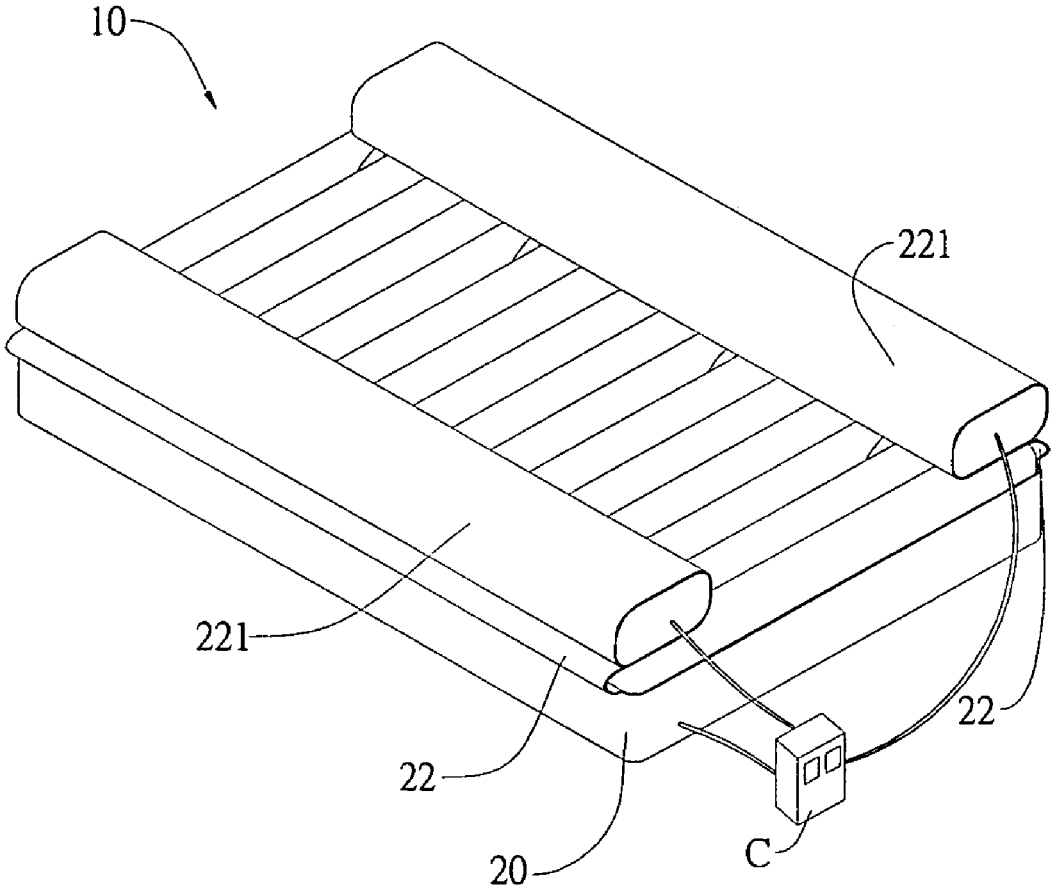
FIG. 6 is an assembled view of a support structure with side guards according to one embodiment of the present invention.

Referring to FIGS. 3 to 5, at least one connection belt 22 is attached to the bottom sheet 20 and encloses the outer edge of the side guard 30. Hence, the side guard 30 is replaceable according to different requirements of different bedded persons. The side guard 30 can be at least one foam body or at least one bladder. The side guard 30 can be taken out easily. The different length of the foams or the bladders can match with each other according to different requirements. Referring to FIG. 6, the connection belt 22 is formed as a bladder 221 disposed on its outer end. When the bladder 221 is inflated by air, the bladder 221 can form the side guard 30. The bladder 221 and the mattress 10 use the same control device C. Hence, it is easy for user to inflate and deflate the bladder 221 and the mattress 10. A quick exhausting device (not shown) is disposed on the bladder 221 for quickly exhausting air from the bladder 221. Hence, the height of the side guard 30 can be reduced quickly and it is convenient for patient to go to the bed, to leave the bed, or to be treated.

Figure 7:
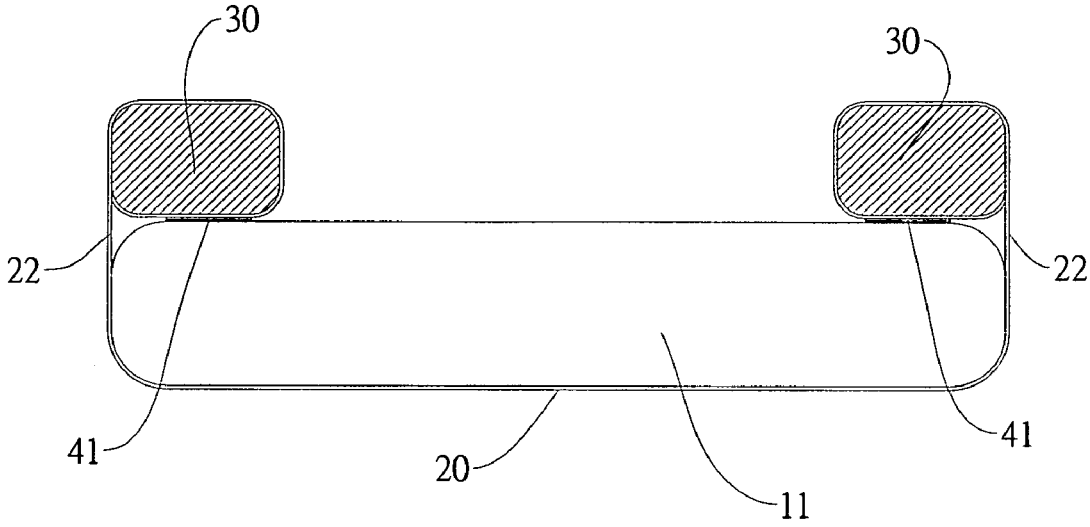
FIG. 7 is a cross-sectional view of a support structure with side guards using a first positioning element according to one embodiment of the present invention.

Referring to FIG. 7, the positioning assembly 40 has at least one first positioning element 41 that can be a non-skid pad disposed on the connection belt 22. Moreover, the non-skid contacts with the mattress 10 in order to increase friction between the mattress 10 and the connection belt 22. Hence, the side guard 30 enclosed by the connection belt 22 or the bladder 221 disposed on the connection belt 22 can stop horizontal force F as shown in FIG. 8 and does not be pushed easily.

Figure 8:
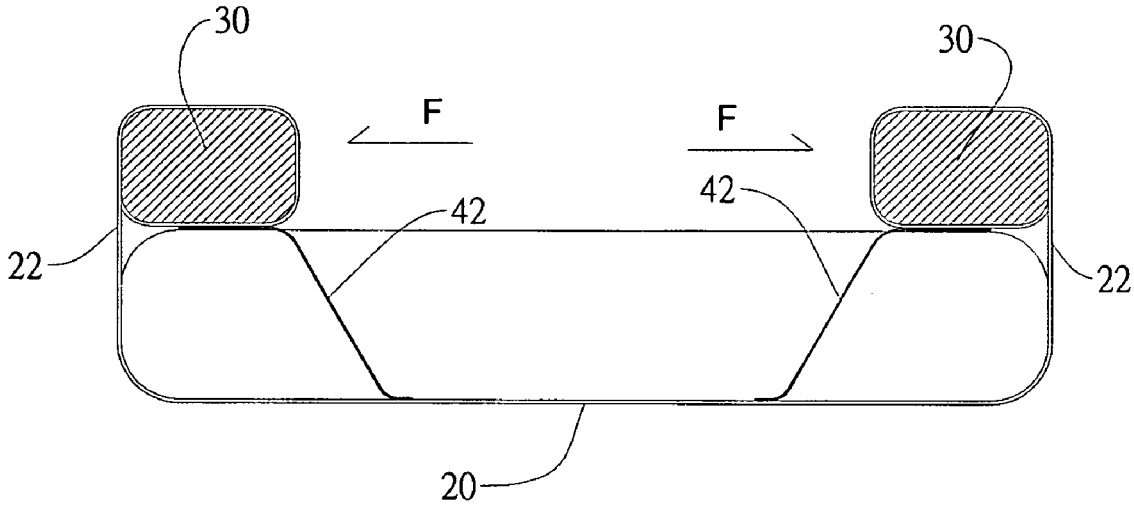
FIG. 8 is a cross-sectional view of a support structure with side guards using a second positioning element according to one embodiment of the present invention.
Figure 8A:
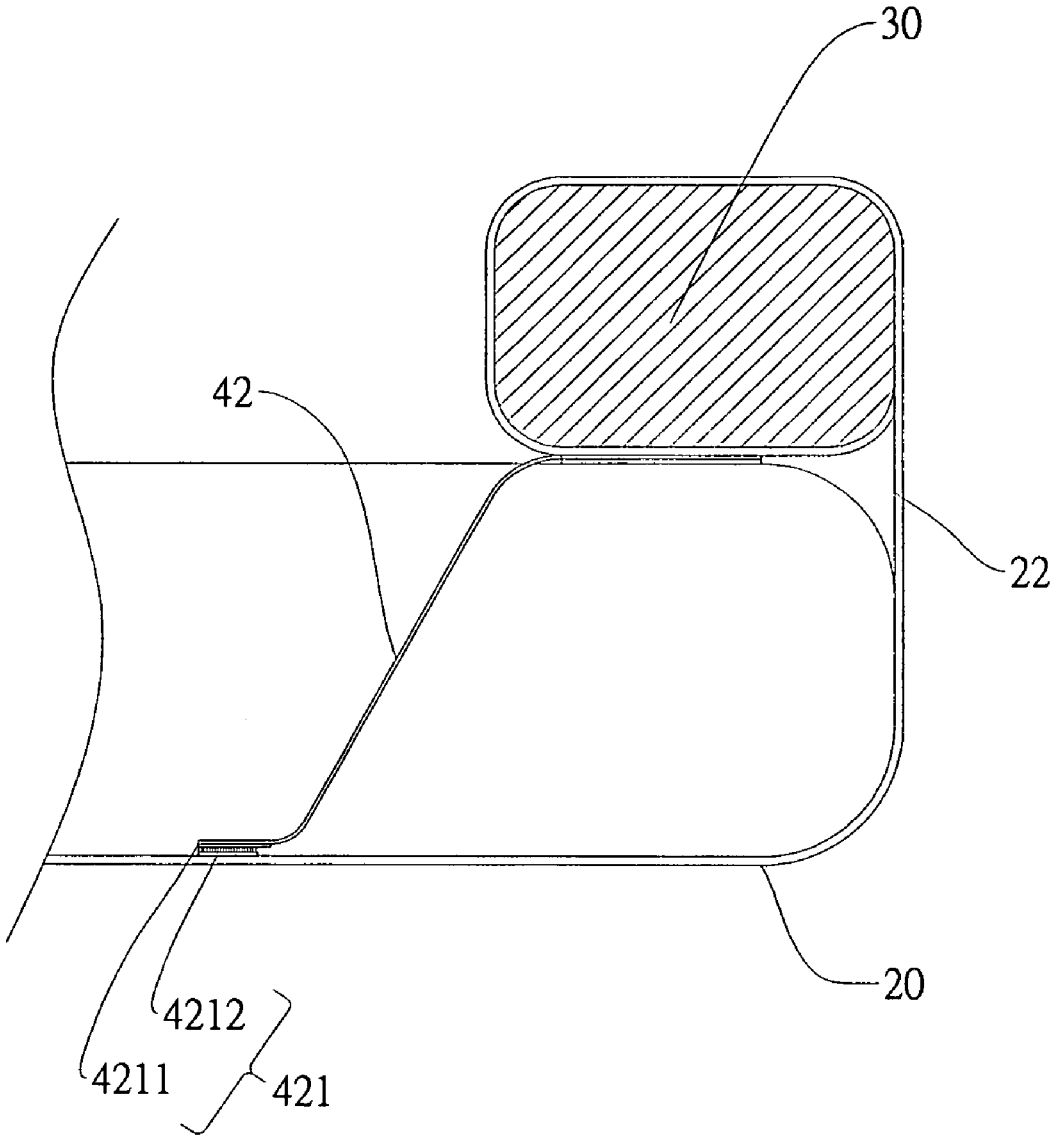
FIG. 8A is a partial, cross-sectional view of a support structure with side guards using two adhesive portions according to one embodiment of the present invention.
Figure 8B:
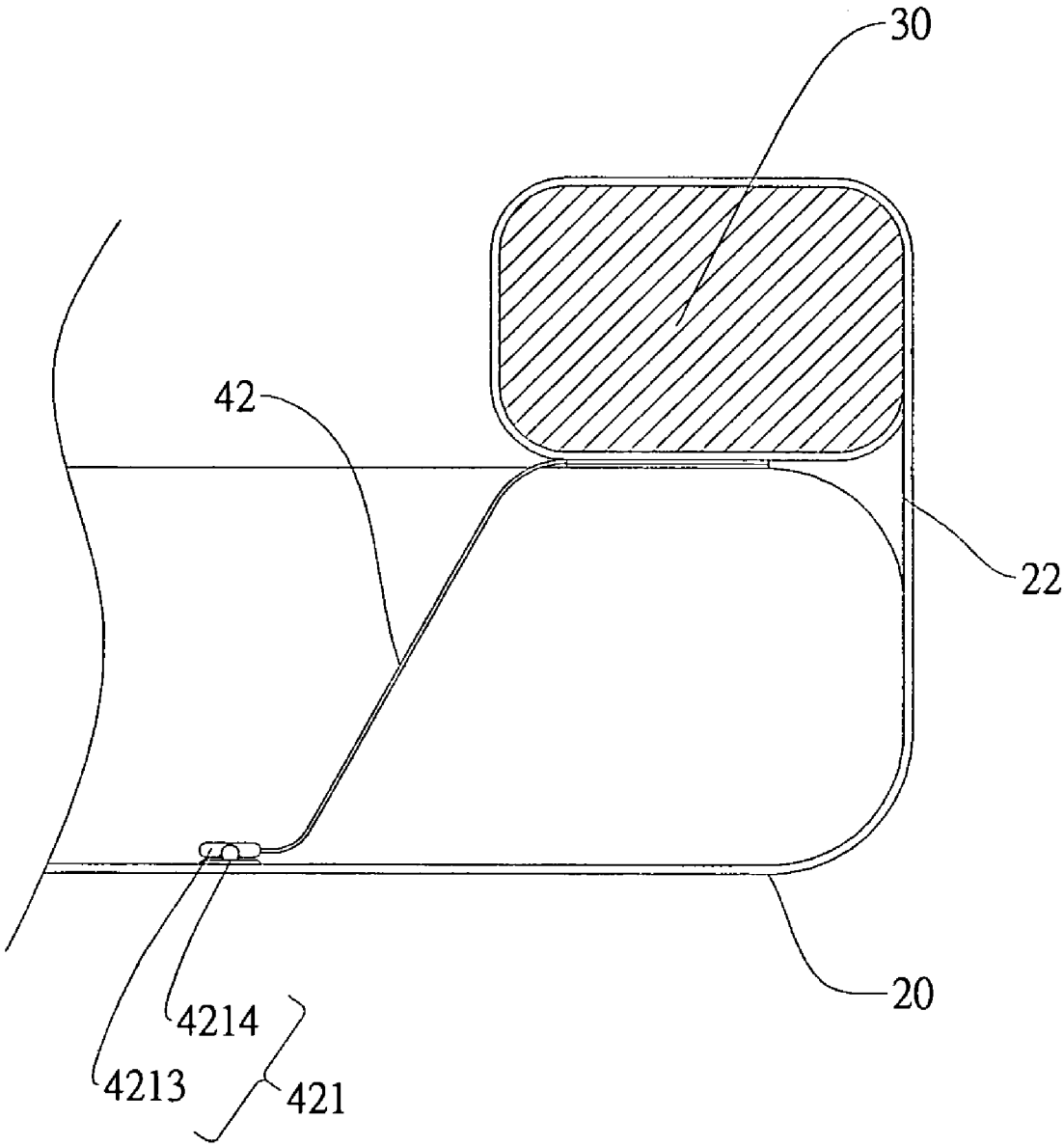
FIG. 8B is a partial, cross-sectional view of a support structure with side guards using two snaps according to one embodiment of the present invention.
Figure 8C:
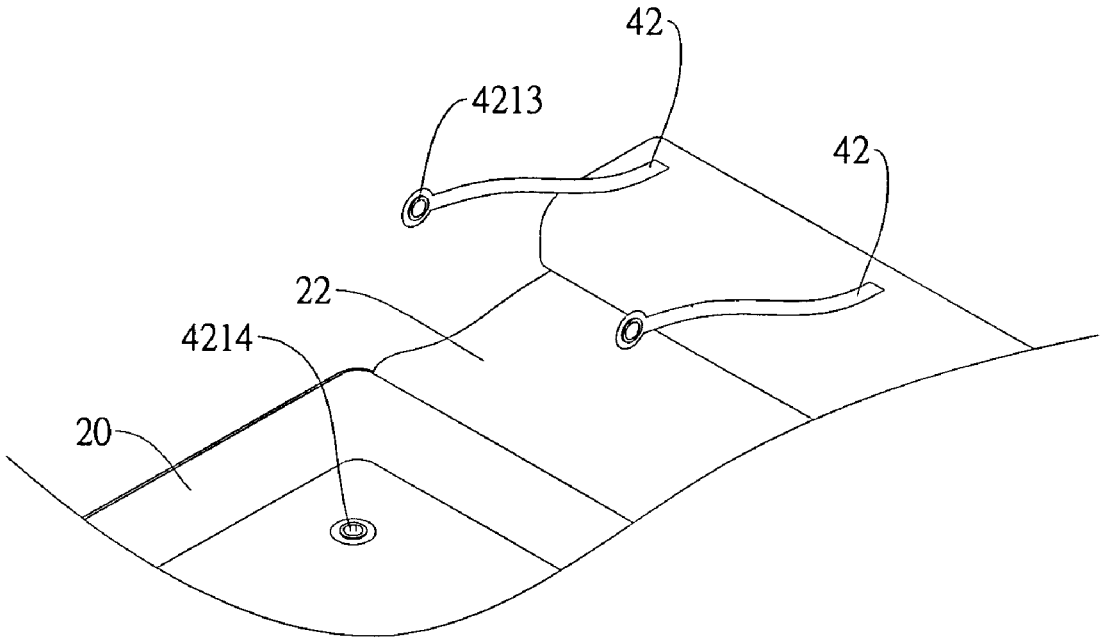
FIG. 8C is a partial, assembled view of a support structure with side guards using two snaps according to one embodiment of the present invention.

Referring to FIGS. 8 to 8C, the positioning assembly 40 has at least one second positioning element 42 that is connected to the bottom sheet 20, the connection belt 22 or the side guard 30, so that the side guard 30 can resist the horizontal force F or an upward force in order to restrict the position of the side guard 30. The second positioning element 42 has at least one pull strap. A fastener 421 connects the second positioning element 42 to the bottom sheet 20. The fastener 421 has at least one female adhesive portion 4211 disposed on the second positioning element 42 and at least one male adhesive portion 4212 disposed on the bottom sheet 20. When the female adhesive portion 4211 and the male adhesive portion 4212 are connected with each other, the position of the side guard 30 relative to the mattress 10 is fixed. Of course, the female adhesive portion 4211 and the male adhesive portion 4212 can be replaced by female snap 4213 and male snap 4214; alternatively, the two positions of the female adhesive portion 4211 and the male adhesive portion 4212 can be exchanged.

Figure 9:
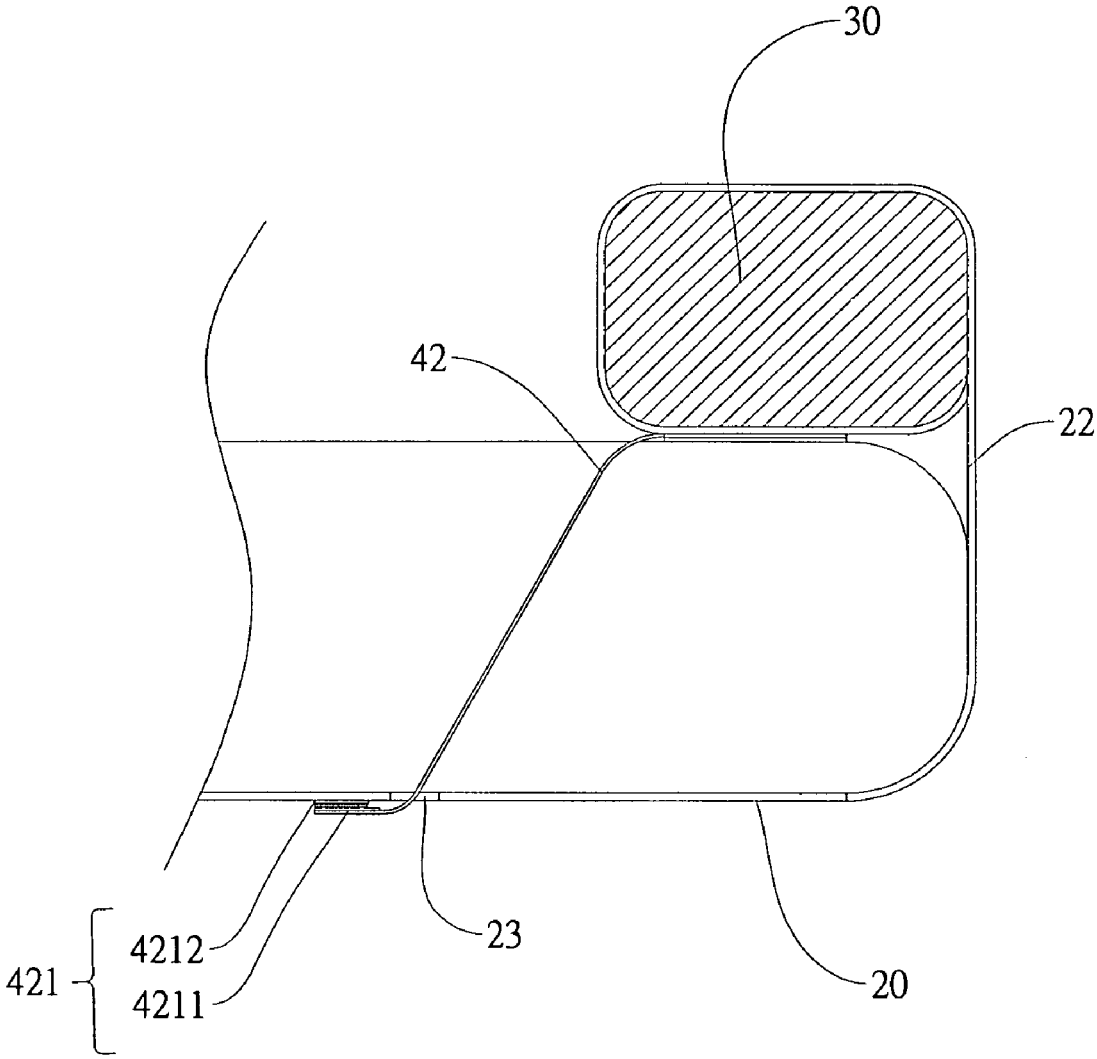
FIG. 9 is a partial, cross-sectional view of a support structure with side guards using two adhesive portions under a bottom sheet according to one embodiment of the present invention.
Figure 10:
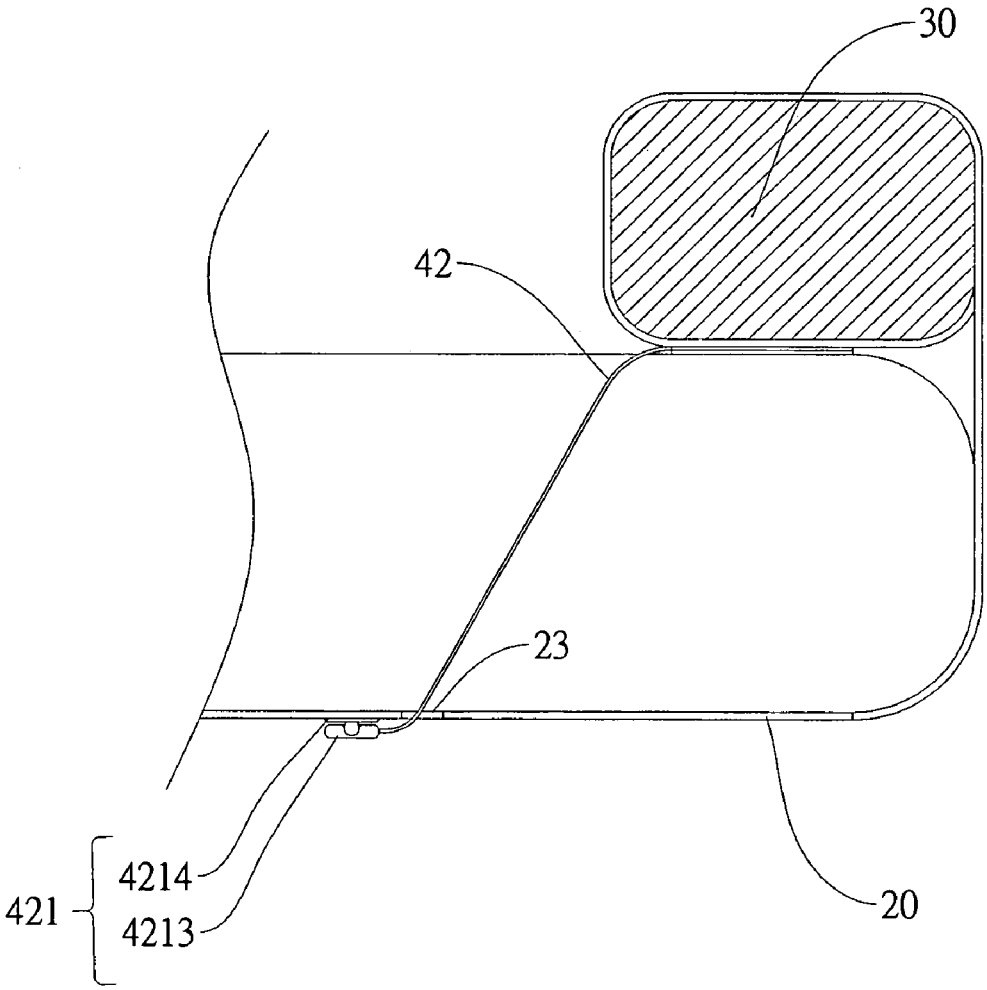
FIG. 10 is a partial, cross-sectional view of a support structure with side guards using two snaps under a bottom sheet according to one embodiment of the present invention.

Referring to FIGS. 9 and 10, the bottom sheet 20 has an opening 23 formed on its bottom side. The fastener 421 is disposed on an outer side of the bottom sheet 20, and fastener 421 passes through the opening 23 in order to connect the female adhesive portion 4211 with the male adhesive portion 4212. Therefore, the fastener 421 is pressed by the weight of the bedded person and the mattress 10, so that the connection relationship between the female adhesive portion 4211 with the male adhesive portion 4212 is good in order to increase the horizontal resistance of the side guard 30. Hence, it is hard for a bedded person to push or lift the side guard 30.

Figure 11:
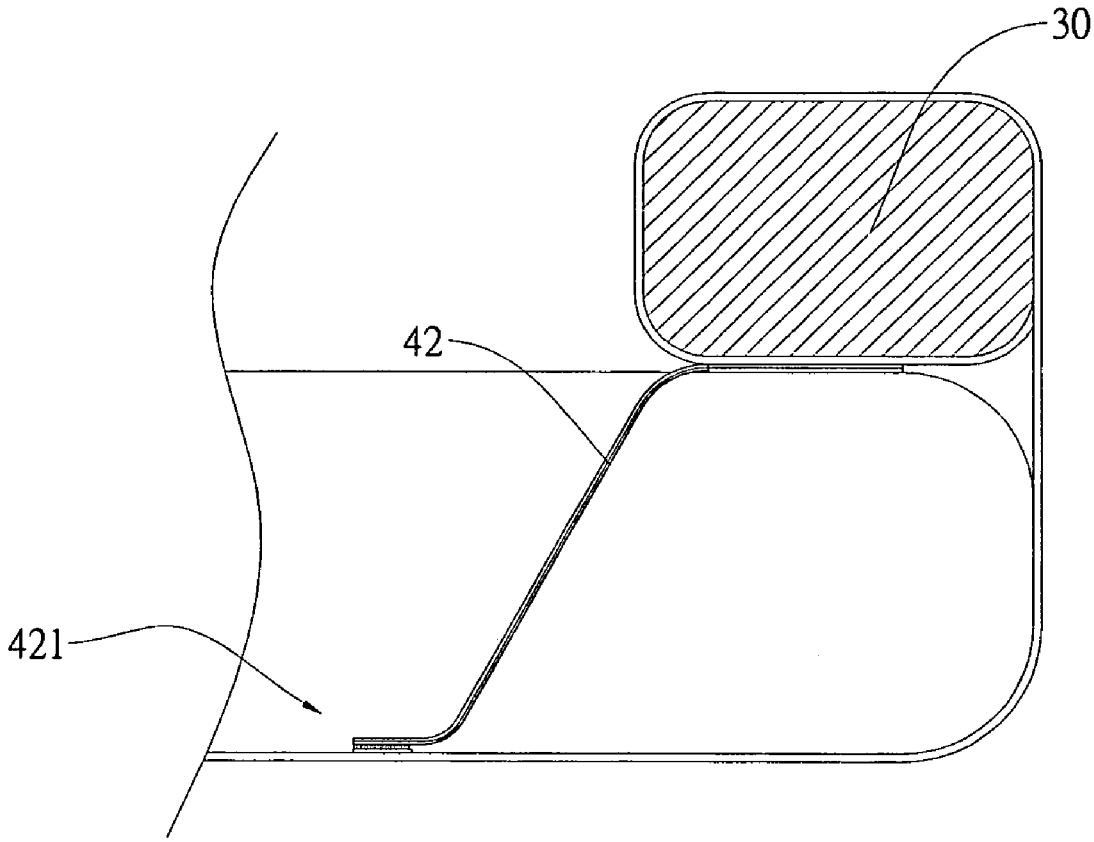
FIG. 11 is a partial, cross-sectional view of a support structure with side guards using two integrated adhesive portions according to one embodiment of the present invention.

Referring to FIG. 11, the second positioning element 42 can be a long narrow female adhesive portion or a long narrow male adhesive portion, and the bottom sheet 20 has a long narrow male adhesive portion corresponding to the long narrow female adhesive portion of the second positioning element 42 or a long narrow female adhesive portion corresponding to the long narrow male adhesive portion of the second positioning element 42. Hence, the long narrow female adhesive portion and the long narrow male adhesive portion are integrated, so that it is convenient for user to adjust the position of the long narrow female adhesive portion and the long narrow male adhesive.

Figure 12:
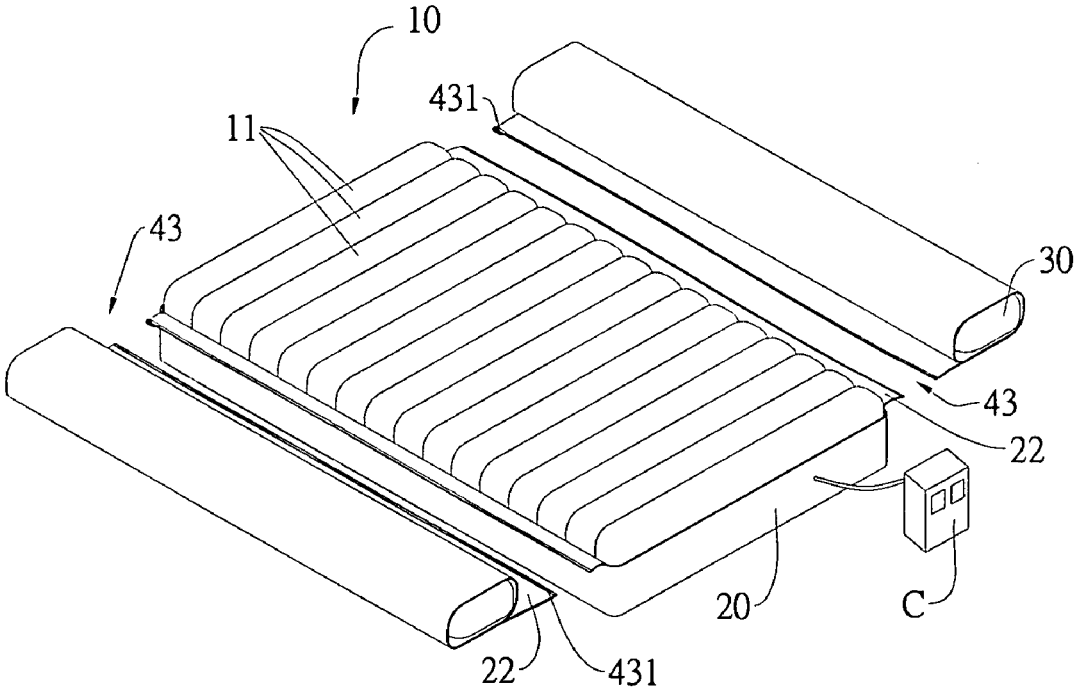
FIG. 12 is a partial, exploded view of a support structure with side guards using a first type of third positioning element according to one embodiment of, the present invention.
Figure 12A:
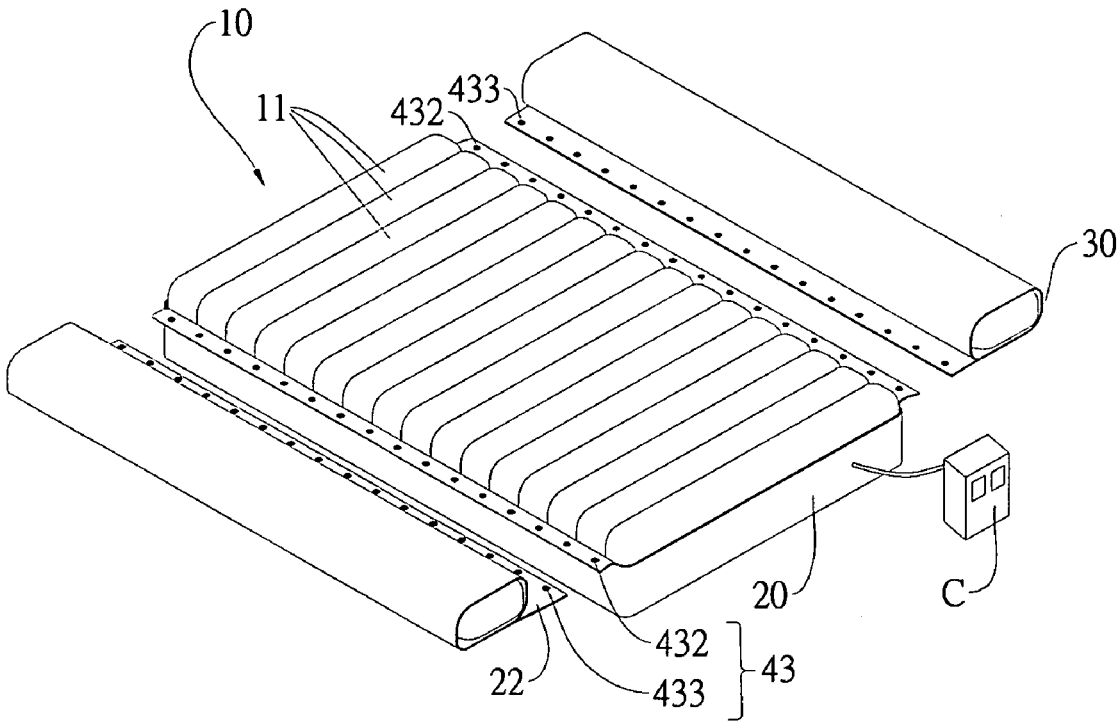
FIG. 12A is a partial, exploded view of a support structure with side guards using a second type of third positioning element according to one embodiment of the present invention.
Figure 12B:
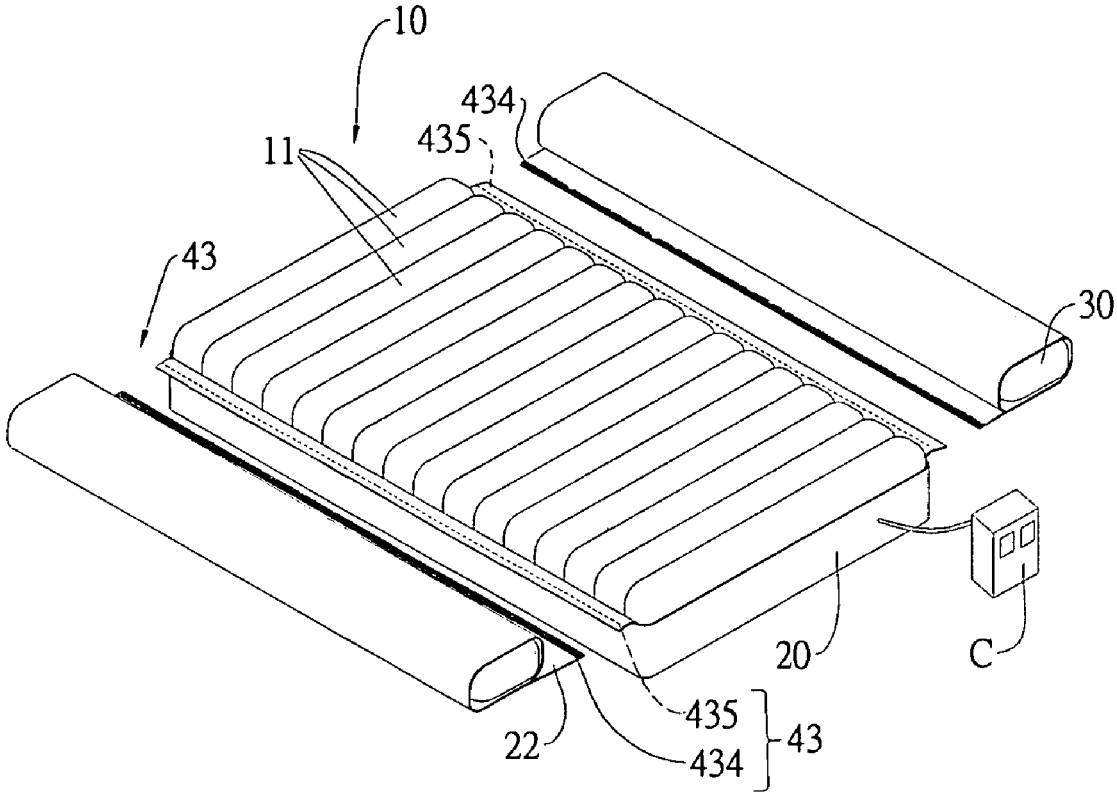
FIG. 12B is a partial, exploded view of a support structure with side guards using a third type of third positioning element according to one embodiment of the present invention.

Referring to FIGS. 12 to 12B, the positioning assembly 40 has a third positioning element 43 that is disposed on the connection belt 22. It is convenient for user to assemble or detach the side guard 30. The third positioning element 43 has a set of zippers 431 (two zippers), at least one male snap 432 and at least one female snap 433, or at least one male adhesive portion 434 and at least one female adhesive portion 435. The two zippers 431 correspond to each other. The male snap 432 and the female snap 433 correspond to each other. The male adhesive portion 434 and the female adhesive portion 435 correspond to each other. Hence, it is convenient for user to assemble or detach the side guard 30 by using the third positioning element 43. The side guard 30 is fixed firmly according to different adhesive positions.

Figure 13:
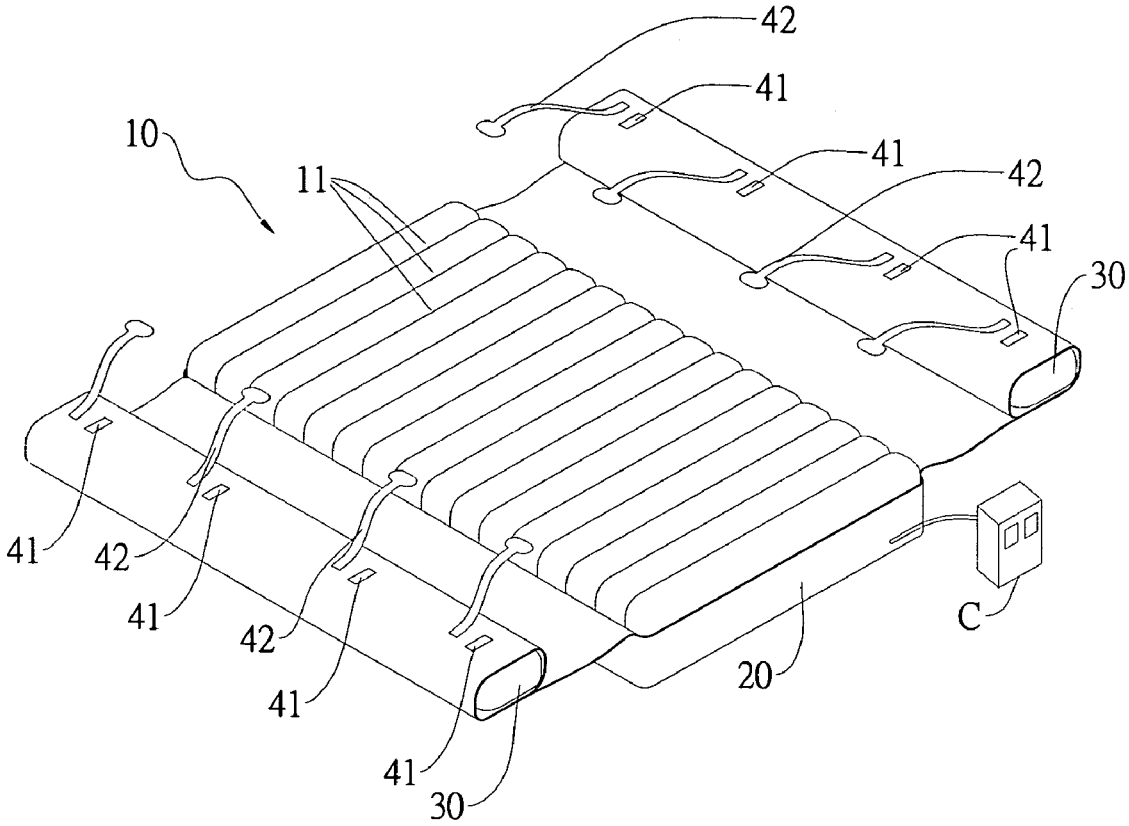
FIG. 13 is a partial, exploded view of a support structure with side guards using a first positioning element and a second positioning element according to one embodiment of the present invention.
Figure 14:
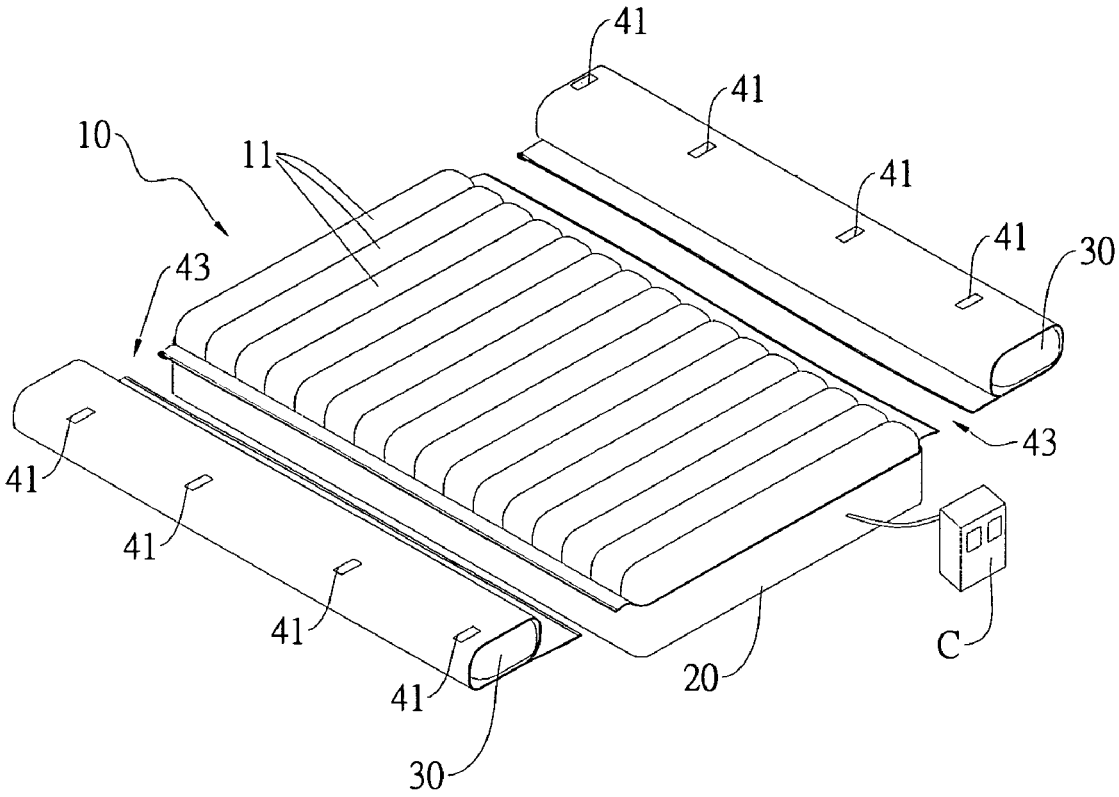
FIG. 14 is a partial, exploded view of a support structure with side guards using a first positioning element and a third positioning element according to one embodiment of the present invention.
Figure 15:
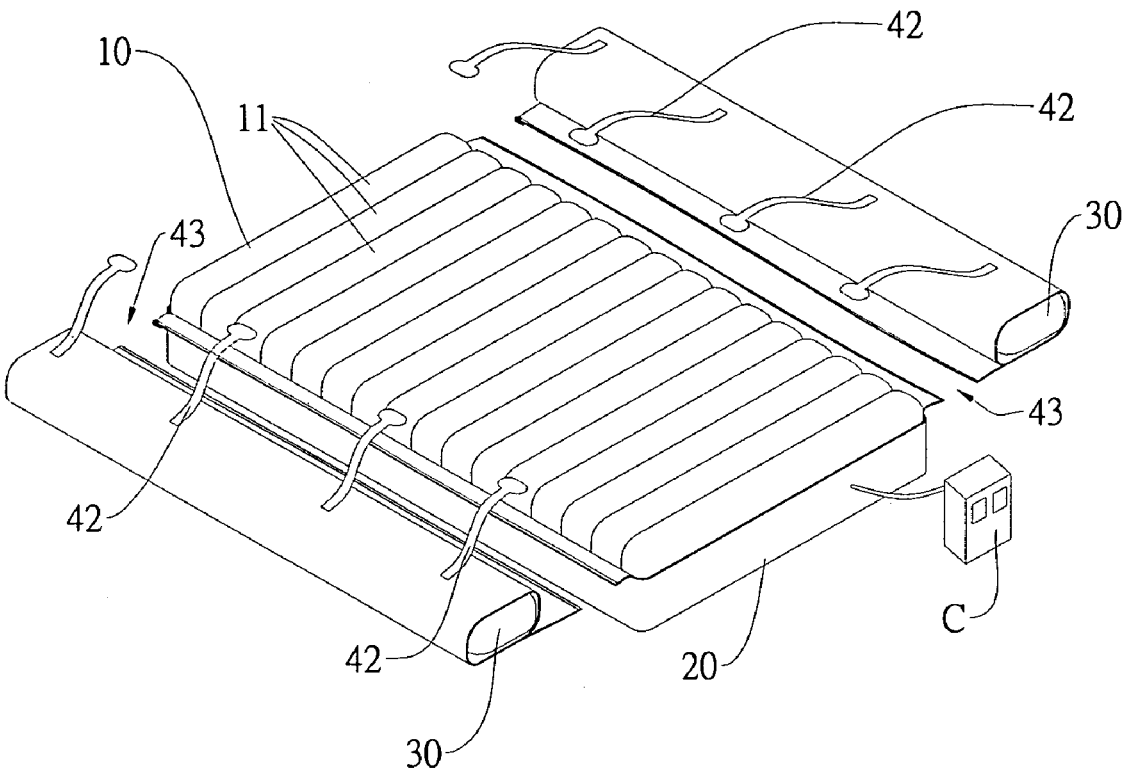
FIG. 15 is a partial, exploded view of a support structure with side guards using a second positioning element and a third positioning element according to one embodiment of the present invention.

Referring to FIGS. 13 to 15, the first positioning element 41, the second positioning element 42 and the third positioning element 43 can be selectively mated with each other to form the positioning assembly 40 according to different requirements.

In conclusion, the side guard 30 is stacked on two lateral sides of the top surface of the mattress 10 and is restricted by using the positioning assembly 40 to protect the bedded person, so that the size of the bladders 11 does not need to be modified. Hence, the side guard 30 matching with the positioning assembly 40 can add product variety and decrease stock cost. If the bladder 221 can form the side guard 30, the bladder 221 and the mattress 10 can share a control device C. Hence, it is easy for user to fill air into the bladder 221 and the mattress 10. When the connection belt 22 encloses the outer edge of the side guard 30, the side guard 30 can be drawn out easily for care workers to treat patient lay on mattress 10.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A support structure, comprising:

a mattress having a plurality of bladders;

a bottom sheet having an interior region for receiving the mattress, the bottom sheet having an opening formed in a bottom side thereof;

at least one side guard having an elongated shape, disposed on one lateral side of a top surface of the mattress;

at least one connection belt connected to the bottom sheet and enclosing the outer edge of the side guard; and at least one positioning assembly disposed between the side guard and the mattress in order to fix the side guard to the mattress, wherein the positioning assembly includes at least one pull strap connected to the bottom sheet, the at least one pull strap being connected to the bottom sheet by a fastener having at least one female adhesive portion disposed on the pull strap and at least one male adhesive portion disposed on an outer side of the bottom sheet, the at least one female portion of the fastener being passed through the opening formed in the bottom side of the bottom sheet to connect with the at least one male adhesive portion of the fastener.

2. The support structure as in claim 1, wherein the side guard is at least one foam body or at least one bladder, and the side guard is enclosed by the connection belt.

3. The support structure as in claim 1, wherein the connection belt has a bladder disposed on its outer end.

4. The support structure as in claim 1, wherein the positioning assembly includes at least one non-skid pad, the non-skid pad disposed on the connection belt, the non-skid pad being in contact with the mattress to increase friction between the mattress and the connection belt.

5. A support structure, comprising:

a mattress having a plurality of bladders;

a bottom sheet having an interior region for receiving the mattress, the bottom sheet having an opening formed in a bottom side thereof;

at least one side guard having an elongated shape, disposed on one lateral side of a top surface of the mattress;

at least one connection belt connected to the bottom sheet and enclosing the outer edge of the side guard; and at least one positioning assembly disposed between the side guard and the mattress in order to fix the side guard to the mattress, wherein the positioning assembly includes at least one pull strap connected to the bottom sheet, the at least one pull strap being passed through the opening formed in the bottom side of the bottom sheet to be fixed on the bottom side of the bottom sheet.

6. The support structure as in claim 5, wherein the side guard is at least one foam body or at least one bladder, and the side guard is enclosed by the connection belt.

7. The support structure as in claim 5, wherein the connection belt has a bladder disposed on its outer end.

8. The support structure as in claim 5, wherein the positioning assembly further includes at least one non-skid pad disposed on the connection belt, the non-skid pad being in contact with the mattress to increase friction between the mattress and the connection belt.

9. The support structure as in claim 5, wherein the positioning assembly further includes at least one pair of complementary adhesive portions of the at least one connection belt, one pair of complementary adhesive portions of the at least one connection belt being coupled to the at least one side guard, whereby the at least one side guard is reversibly detachable from the support structure.

10. The support structure as in claim 5, wherein the positioning assembly further includes at least one pair of corresponding zipper portions of the at least one connection belt, one of the pair of corresponding zipper portions of the at least one connection belt being coupled to the at least one side guard, whereby the at least one side guard is reversibly detachable from the support structure.

11. A support structure, comprising:

a mattress having a plurality of bladders;

a bottom sheet having an interior region for receiving the mattress, the bottom sheet having an opening formed in a bottom side thereof;

at least one side guard having an elongated shape, disposed on one lateral side of a top surface of the mattress;

at least one connection belt connected to the bottom sheet and enclosing the outer edge of the side guard; and at least one positioning assembly disposed between the side guard and the mattress in order to fix the side guard to the mattress, wherein the positioning assembly includes at least one first positioning element connected to the connection belt, and at least one second positioning element connected to the bottom sheet, the at least one second positioning element being formed by an elongated adhesive portion, the outer sheet having a complementary adhesive portion disposed on an outer side thereof, the elongated adhesive portion of the at least one second positioning element being passed through the opening formed in the bottom side of the bottom sheet to connect with the complementary adhesive portion on the outer side of the outer sheet.

12. The support structure as in claim 11, wherein the side guard is at least one foam body or at least one bladder, and the side guard is enclosed by the connection belt.

13. The support structure as in claim 11, wherein the connection belt has a bladder disposed on its outer end.

14. The support structure as in claim 11, wherein the at least one first positioning element is a non-skid pad disposed on the connection belt, the non-skid pad being in contact with the mattress to increase friction between the mattress and the connection belt.

15. The support structure as in claim 11, wherein the at least one second positioning element is a pull strap.

16. The support structure as in claim 11, wherein the positioning assembly further includes at least one third positioning element joining a pair of adjacent portions of the at least one connection belt, one of the pair of portions of the at least one connection belt being coupled to the at least one side guard, the at least one third positioning element being formed by a fastener, whereby the at least one side guard is reversibly detachable from the support structure.

17. The support structure as in claim 16, wherein the fastener includes a pair of complementary adhesive portions respectively coupled to the pair of portions of the at least one connection belt.

18. The support structure as in claim 16, wherein the fastener includes a pair of corresponding zipper portions respectively coupled to the pair of portions of the at least one connection belt.

19. The support structure as in claim 1, wherein the positioning assembly further includes at least one a pair of complementary adhesive portions of the at least one connection belt, one of the pair of complementary adhesive portions of the at least one connection belt being coupled to the at least one side guard, whereby the at least one side guard is reversibly detachable from the support structure.

20. The support structure as in claim 1, wherein the positioning assembly further includes at least one a pair of corresponding zipper portions of the at least one connection belt, one of the pair of corresponding zipper portions of the at least one connection belt being coupled to the at least one side guard, whereby the at least one side guard is reversibly detachable from the support structure.

* * * * *